United States Patent [19]

Williams

[11] 4,271,916

[45] Jun. 9, 1981

[54] SYSTEM FOR ADAPTING TOP HEAD DRILLING RIGS FOR REVERSE CIRCULATION DRILLING

[76] Inventor: Paul Williams, 275 Courtney La., Reno, Nev. 89523

[21] Appl. No.: 36,114

[22] Filed: May 4, 1979

[51] Int. Cl.[3] ..... E21B 11/12; E21B 21/02

[52] U.S. Cl. ..... 175/215; 173/57; 175/320; 285/137 A

[58] Field of Search ..... 175/324, 215, 171, 320; 285/137 A; 173/57

[56] References Cited

U.S. PATENT DOCUMENTS

| | | | |
|---|---|---|---|
| 2,304,394 | 12/1942 | Biermann et al. | 285/137 A |
| 3,280,925 | 10/1966 | Becker et al. | 175/215 X |
| 3,489,438 | 1/1970 | McClure | 175/215 |
| 3,601,206 | 8/1971 | Giantom | 175/215 |
| 3,645,343 | 2/1972 | Mays | 173/57 |
| 3,774,697 | 11/1973 | Brown | 175/215 X |
| 4,171,187 | 10/1979 | Reed | 175/215 X |

*Primary Examiner*—William F. Pate, III

*Attorney, Agent, or Firm*—Harris Zimmerman; Howard Cohen

[57] ABSTRACT

A system for adapting top head drilling rigs for reverse circulation drilling includes a generally tubular adapter having an upper end which is threadedly received in the drive head of a top head drill rig. A collar is secured to the tubular adapter by a pair of rotary bearings and includes an exhaust chute for drilling debris and water. A sleeve is also secured to the tubular adapter by rotary bearings, and is provided with an annular chamber which receives compressed air from an outside source. The system also includes a plurality of lengths of drilling pipe having complementary interior and exterior threads at opposed ends thereof. The drilling pipe includes couplings at each end thereof which are joined in sealing relationship by the threaded engagement thereof. A hollow tube is secured to the exterior of the drilling pipe to provide an air flow path between the couplings at the opposed ends thereof. The hollow tubing extends to the sleeve of the adapter to conduct compressed air therefrom down the drilling pipe assembly to purge water and drilling debris from the hole.

9 Claims, 5 Drawing Figures

FIG_3
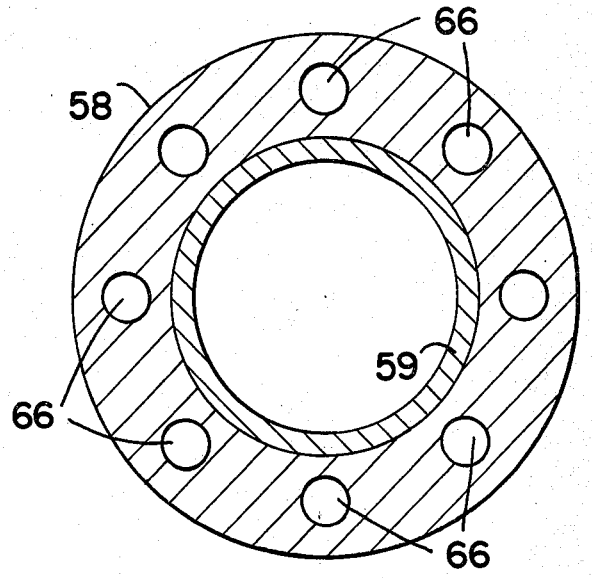
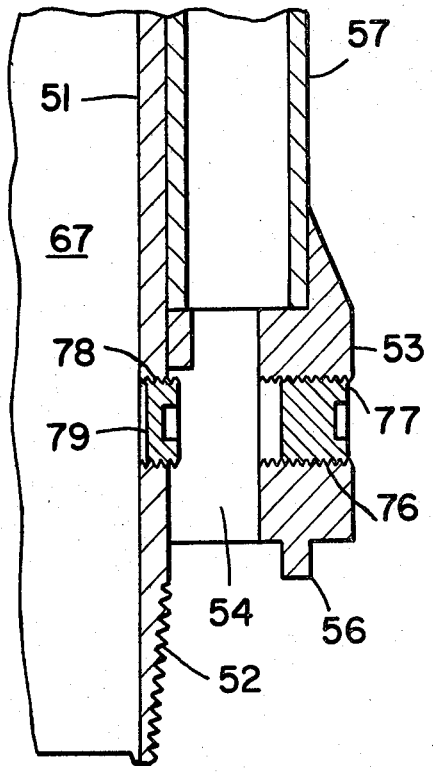
FIG_4
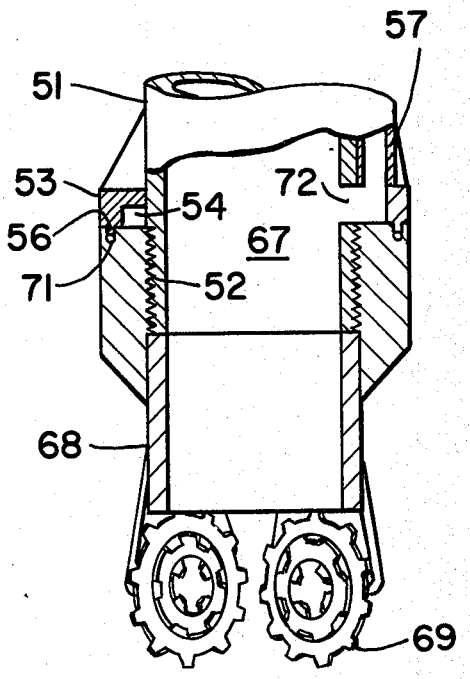
FIG_5

SYSTEM FOR ADAPTING TOP HEAD DRILLING RIGS FOR REVERSE CIRCULATION DRILLING

BACKGROUND OF THE INVENTION

In the field of well drilling, top head drive drilling rigs have gained immense popularity in recent years. These drilling rigs include a tower pivotally mounted on a truck bed, together with a hydraulic pump, an air compressor, and other ancillary equipment. The hydraulic pump actuates leveling jacks, hydraulic pistons to raise the tower, and a hydraulic motor in the top head drive which translates vertically along the tower. The top head drive unit is driven vertically upwardly or downwardly to urge the drill bit into engagement in the hole or to remove the drilling pipe and bit from the hole. In general, top head drive drilling rigs are highly portable, rugged, versatile, and efficient.

Generally speaking, top head drive drilling rigs employ drilling pipe which is provided with threaded couplings at either end. The drilling pipe is generally narrow in outside diameter, and the flow path through the interior of the pipe is restricted by the narrow internal diameter at the tapered, threaded ends thereof. As a result, reverse circulation drilling methods (in which air, water, drilling debris, and the like are pumped out of the well through the interior of the drilling pipe) are not possible with top head drive drilling rigs. Rather, air, water, mud, and the like are injected into the well through the interior of the connected drilling pipes, and the outflow of these materials in the annular space between the drilling pipe and the well circumference carries the drilling debris to the surface. This arrangement is quite effective for drilling shallow or narrow diameter wells.

However, the constrictions caused by the narrow internal diameter at the threaded ends of the drilling pipe prevent the pumping of large volumes of water or mud through the interior of the drilling pipe to any greater depth. As a result, it is difficult to drill large diameter holes with a top head drilling rig, and it is also difficult to pump water or drilling mud to any great depth through the assembled drilling pipes. As a result, deep wells are beyond the reach of top head drilling rigs known in the prior art.

SUMMARY OF THE PRESENT INVENTION

The present invention generally comprises a system for adapting top head drive drilling rigs to enable them to perform reverse circulation drilling. Thus the system of the present invention modifies top head drive drilling rigs so that they may drill deeper holes of wider diameter.

The invention includes a generally cylindrical, tubular adapter member having a tapered upper end which is threaded to be received in the drive head of a top head drive drill rig. A collar is rotatably secured to the upper end of the adapter member adjacent to the tapered end, and is secured to the drilling tower so that the collar remains stationary as the adapter member is rotated. A series of circumferentially spaced holes extend from the interior of the adapter member to an annular chamber within the collar. An exhaust chute extends from the collar to eject drilling debris, water, or mud which travels up the drilling pipe, through the adapter and into the collar.

The adapter member also includes a sleeve which is secured about the exterior thereof in rotatable fashion.

The sleeve includes a closed annular chamber which is supplied with compressed air. The lower end of the adapter member is provided with slightly tapered threads and an annular coupling member disposed directly adjacent thereto. A hollow tube is secured to the exterior of the adapter member, extending between the annular chamber of the sleeve and the coupling member.

In accordance with the present invention, each length of drilling pipe employed in the system is provided with tapered interior threads at the upper end thereof and tapered exterior threads at the lower end thereof. Also, the upper end of each length of drilling pipe is provided with an upper annular coupling member, while the lower end of each length of drilling pipe is provided with a lower annular coupling member. The upper and lower annular coupling members are brought into engagement by the threaded engagement of adjacent drilling pipes to form a pneumatic seal. An external hollow tube is secured to each length of drilling pipe to conduct compressed air between the respective upper annular and lower annular coupling members. Thus a flow path for compressed air extends from the sleeve of the adapter member down through each successive length of drilling pipe within the drilled hole. The hollow interior chamber formed by the joined lengths of drilling pipe has no narrow constrictions, and is capable of carrying drilling debris and cleansing water or mud from the drilling bit upwardly through the interior chamber of the assembled drilling pipes to the collar at the upper end of the adapter member.

A BRIEF DESCRIPTION OF THE DRAWING

FIG. 3 is a cross sectional view taken along line 3—3 of FIG. 1.

FIG. 4 is an enlarged cross sectional view of a further embodiment of the present invention.

FIG. 5 is a cross sectional elevation of the drilling bit mounting of the present invention.

DESCRIPTION OF THE PREFERRED EMBODIMENT

Figure 1:
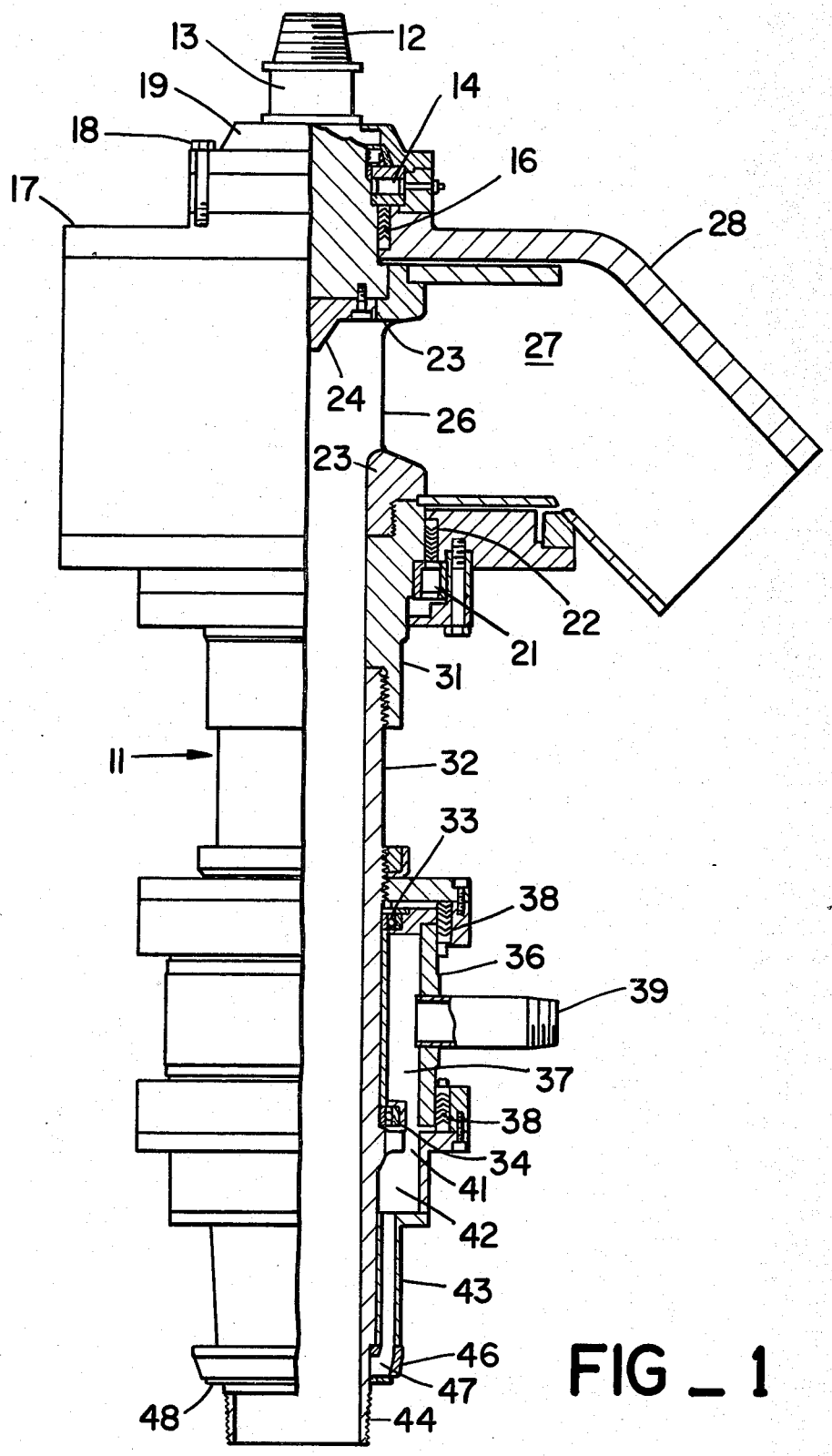
FIG. 1 is a cross sectional elevation of the adapter member of the system of the present invention.

The present invention generally comprises a system for adapting top head drive drilling rigs to accomplish reverse circulation drilling. As shown in FIG. 1, the invention includes a generally cylindrical, tubular adapter assembly 11 having a tapered fitting 12 at the upper end thereof threaded to be received in the drive head of a top head drive drilling rig. The tapered end 12 is formed at the upper end of a post 13, about which a rotary bearing 14 is received together with a packing seal 16. A stationary, annular housing 17 is secured about the post 13 by bolts 18 extending through a keeper plate 19 to the housing 17. The housing is likewise secured at its lower end to rotary bearing 21, with packing 22 being similarly provided. Thus, the annular housing 17 is adapted for relative rotation with respect to the assembly 11. Indeed, the housing 17 is secured to the drilling tower in stationary fashion, so that the assembly 11 may rotate while the housing 17 is rotationally stationary.

Joined to the lower end of the post 13 is a cage member 23 having a conical protrusion 24 extending downwardly therefrom along the axis of the assembly 11. A series of ports 26 are spaced circumferentially in the cage member 23 to provide open communication to the interior chamber 27 of the annular housing 17. An exhaust chute 28 extends outwardly and obliquely downwardly from the housing 17 to provide a discharge path from the interior chamber 27, as will be explained more fully in the following description.

Joined to the lower end of the cage member 23 is a cylindrical member 31 about which the bearing 21 and packing 22 are received. A long tubular member 32 is threadedly secured to the lower end of the member 31. Secured about the member 32 in axially spaced relationship are a pair of rotary bearings 33 and 34. The bearings 33 and 34 support an annular sleeve 36 in relative rotation to the assembly 11, so that the sleeve 36 may remain stationary while the assembly 11 rotates. The sleeve 36 defines an annular chamber 37 which is sealed by packing rings 38 interposed between the sleeve 36 and upper and lower flanges extending from the assembly 11. An air inlet supply nipple 39 extends radially outwardly from the sleeve 36, and is adapted to connect to a compressed air supply hose.

An annular passageway 41 in the lower flange communicates with an annular chamber 42 which is provided in the rotating assembly 11. Extending from the chamber 42 is an external tube 43 which is secured to the exterior of the lower end of the assembly 11. The lower distal end of the assembly 11 is provided with an externally threaded portion 44 which is slightly tapered toward the distal end thereof. Directly adjacent to the threaded end 44 is a collar 46 having an interior annular chamber 47. Projecting downwardly from the collar 46 is a sealing rim 48 which extends continuously thereabout. The threaded end 44 is adapted to be secured to the upper end of a length of drilling pipe which comprises the upper end of a long chain of assembled drilling pipes, the lower end of which terminates in a drilling bit in the hole being drilled.

It may be understood that the upper end 12 of the adapter is secured in the top drive head of a top head drive drilling rig. The assembly 11 is thus rotated thereby, while the housing 17 and the sleeve 36 remain rotationally stationary. The drilling debris, water, drilling mud or the like are carried upwardly through the interior cylindrical cavity of the drilling pipe assembly, and are carried through the interior cavity of the assembly 11 in the fashion of reverse circulation drilling known in the art.

These materials strike the member 24 and are diverted thereby into the chamber 27, from which they are discharged by the chute 28. The compressed air supplied to the inlet nipple 39 passes through the chamber 37, the passage 41, and the tube 43 to the chamber 47 of the collar 46. The compressed air then flows downwardly through a coupling and thence through the assembled drilling pipe chain into the hole being drilled, as will be explained in the following.

Figure 2:
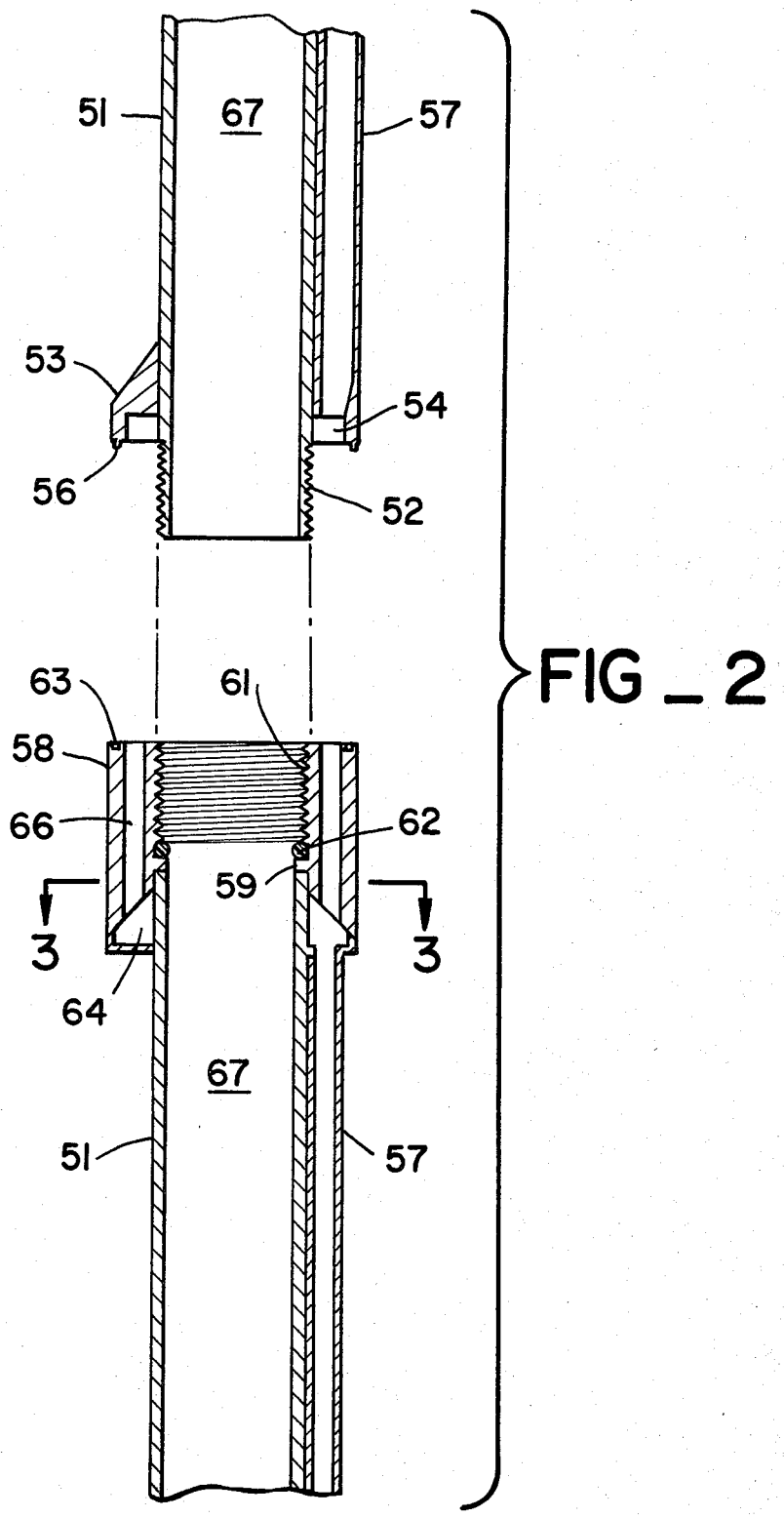
FIG. 2 is an elevation of the adapter member and drilling pipe assembly of the present invention.

With reference to FIG. 2, the present invention also provides a plurality of lengths of drilling pipe 51. The lower end of each length of pipe 51 is provided with a slightly tapered threaded portion 52 which is similar to or identical with the threaded portion 44 of the assembly 11. Directly adjacent to the threaded portion 52 is a collar 53 which is secured about the pipe 51 and which is provided with an annular chamber 54 therein. The chamber is downwardly opening, and a sealing rim 56 extends downwardly from the lower end of the collar 53. A hollow rectangular tube 57 is secured by welding to the exterior of the pipe 51, extending parallel to the axis thereof. The interior of the tube 57 is connected in open flow communication with the chamber 54.

A large hollow cylindrical member 58 is joined to the upper end of each length of pipe 51. An inwardly projecting flange 59 abuts the upper end of the length of pipe 51, and is welded thereto. The upper portion of the interior bore of the member 58 is provided with interior threads 61 which are adapted to mate with the threads 52 of the lower end of a corresponding drilling pipe. An O-ring 62 is disposed in the thread relief adjacent to the interior flange 59 to effect a pressure tight seal with the lower end of the threaded portion 52 of the mating pipe section. An annular groove 63 is disposed in the upper end of the member 58 to receive a smaller diameter O-ring seal. The groove 63 receives the sealing rim 56 of a mating pipe section, and the O-ring therein forms an effective, pressure-tight seal.

Disposed within the lower end of the member 58 is an annular chamber 64 which is connected in open flow communication with the upper end of the rectangular tube 57. A plurality of flow passages 66 extend from the chamber 64 to the upper end of the member 58. The passages 66 are disposed parallel to the axis of the pipe, and are spaced circumferentially about the member 58, as shown in FIG. 3.

When two pipe sections are joined together, the threaded portion 52 is received by the threaded portion 61 of the adjacent pipe section. When these threaded portions are tightened, the sealing rim 56 engages the groove 63 to form a seal therewith, while the lower end of the threaded portion 52 impinges on the O-ring 62 likewise to form a seal therewith. In this disposition, the passageways 66 are in flow communication with the chamber 54 of the adjacent pipe section. Thus a pressure-tight coupling is formed between the connected pipe section, so that compressed air or fluid may flow down through the tube 57, into the chamber 54, down through the plurality of passages 56 and into the chamber 64. The pressurized gas or fluid may then flow into the tube 57 connected to the chamber 64, and thence downwardly to the next coupling joining the successive subjacent pipe section. In this manner compressed air or fluid may be delivered down the assembled chain of drilling pipe to the drilling bit or to whatever depth required. The bore 67 of each length of drilling pipe is open and free of any blockage so that drilling debris, water, drilling mud, or the like may be carried upwardly therethrough by the pressurized gas or fluid which is delivered down the hole by the assembled couplings and tubings 57.

It may be appreciated that the number and size of the passages 66 in the member 58 are selected to provide an ample flow path for the compressed gas or fluid which is delivered down the assembled drilling pipe. The holes 66 cannot be too large or too closely spaced, due to the fact that the member 58 transmits a high torque force to the length of drilling pipe to which it is assembled. Furthermore, it should be noted that in the event that a high rate of flow of compressed gas or fluid is desired downhole, two or more rectangular tubes 57 may be secured to each length of drill pipe 51 between the upper chamber 64 and the lower chamber 54 thereof.

With reference to FIG. 5, the lowermost section of drilling pipe 51 terminates in a collar 53 as described in the foregoing. The threaded portion 52 receives the drilling bit assembly 68 which is provided at its upper end with an O-ring groove 71 to receive the sealing rim 56 of the collar 53. The lower end of the lowermost pipe section 51 includes a passageway 72 which extends between the annular chamber 54 and the interior bore 67 of the pipe. The compressed air, gas, or pressurized fluid delivered through the passageway 72 from the tube 57 causes the water or mud within the drilling hole and bore 67 to rise through the bore 67 and through the assembled chain of drilling pipe. Thus the pressurized fluid or gas which enteres the bore 67 through the passageway 72 exerts a pumping effect to cause any liquid in the bore 67 to rise through the drilling pipe assembly. This pumping effect causes a siphon effect at the lower end of the drilling bit assembly, where the wheel type drilling bits are secured. Drilling debris which is ground by the bits 69 is carried by water or mud at the bottom of the drilling hole into the bore 67 by the siphoning effect, and thence upwardly through the drilling pipe assembly and through the adapter assembly 11 to be discharged by the chute 28 thereof.

In deep well drilling, the hydrostatic pressure at the bottom of a hole being drilled may exceed the pressure of the gas or fluid being delivered through the tubes 57 and the passageway 72. In this circumstance the pressurized gas or fluid will have no pumping effect or siphon effect in the vicinity of the drilling bit. To overcome this potential problem, the present invention includes a provision of specially adapted sections of drilling pipe which may be placed in the drilling pipe chain as required to effect upward pumping of the drilling debris and water or mud. As shown in FIG. 4, the lower end of a specially adapted section of drilling pipe includes a collar 53 having an annular chamber 54 which communicates with external rectangular tube 57, all as described in the foregoing. Disposed in the collar 53 is a threaded hole 76 in which a threaded plug 77 is received. The threaded hole 76 extends generally radially, and is aligned with a radially extending threaded hole 78 in the wall of the pipe 51. A threaded plug 79 is secured in the hole 78.

Prior to the specially adapted pipe section being inserted into the hole being drilled, the threaded plug 77 may be removed to gain access to the plug 79. The plug 79 may be unscrewed from the hole 78 so that the pressurized gas or fluid delivered to the chamber 54 may be introduced through the hole 78 into the bore 67 of the pipe 51. The plug 77 may be re-inserted in the hole 76 so that none of the pressurized gas or fluid escapes outside of the assembled piping system. With the hole 78 open and the specially adapted pipe disposed partway down the hole being drilled, the pressurized gas or fluid introduced into the bore 67 through the hole 68 will cause a pumping action and siphoning action exactly as that described in the foregoing. This pumping and siphoning action will draw upwardly any liquid within the bores 67 of the assembled pipe chain, so that water or mud will be drawn upwardly through the entire length of the assembled pipe chain. In this way, the drilling debris generated by the drilling bits 69 will be siphoned upwardly through the assembled drilling pipe and out the discharge chute 28.

It may be appreciated that the adapter assembly 11 is designed to be secured to the drilling pipe 51 described herein, so that a top head drive drilling rig may be adapted for reverse circulation drilling. However, it should be noted that the drilling pipe 51 described herein may also be used with other forms of driling rigs other than top head drive units. The drilling pipe 51 and the couplings therewith provide excellent reverse circulation flow, and are easily assembled or disassembled because of the tapered, threaded connections therebetween. Furthermore, the drilling pipes 51 have a more narrow profile than the flange-connected drilling pipe assemblies which are typically used in most reverse circulation drilling. Thus the problems associated with flanged couplings, such as binding in loose rock in the drilled hole, or stripping of the bolts which connect the flange couplings, are eliminated by the drilling pipe described herein.

I claim:

1. A system for adapting a top head drive drilling rig having a tapered threaded socket for securing threaded drill pipe to reverse circulation drilling, comprising a generally cylindrical, tubular adapter assembly having a bore extending axially therethrough, a tapered threaded member extending axially from one end of said assembly for engaging said socket of a top head drive; an annular housing disposed about a portion of said assembly, first bearing means for supporting said housing in relative rotation with said assembly, said housing including an annular chamber communicating with said bore, a discharge chute extending from said chamber to the exterior of said housing; an annular sleeve disposed about said assembly, second bearing means for supporting said sleeve in relative rotation with said assembly, pressurized fluid delivery means joined to said sleeve, threaded coupling means extending from the other end of said assembly and adapted to be joined to a section of drilling pipe having a complementary threaded coupling means at the upper end thereof, pressure tight coupling means extending between said upper end of said drilling pipe section and said other end of said assembly, and means on said assembly for connecting said pressurized fluid delivery means and said pressure tight coupling.

2. The system of claim 1, wherein said pressure tight coupling means includes a collar member extending about said assembly adjacent to said threaded coupling means, and a cylindrical member secured to said upper end of said drilling pipe, said collar and cylindrical member being adapted for confronting, sealing relationship.

3. The system of claim 2, wherein said collar includes an annular cavity opening downwardly, and said cylindrical member includes a plurality of passages extending longitudinally therethrough, said passages being disposed in open flow relationship with said annular cavity when said coupling is joined.

4. The system of claim 3, wherein said pressurized fluid delivery means is connected in open flow communication to said annular cavity.

5. The system of claim 1, further including an O-ring seal disposed in the upper end of said cylindrical member, and an annular rim extending from said collar to engage said O-ring seal.

6. The system of claim 1, wherein said pressure tight coupling means is joined by engagement of said threaded coupling means extending between said assembly and said section of drilling pipe.

7. The system of claim 1, wherein said sleeve includes a sealed annular volume therein, and said last mentioned means includes a tube extending between said sealed annular volume and said pressure tight coupling to provide flow communication therebetween.

8. The system of claim 7, wherein said sleeve includes a pressurized fluid inlet nipple extending therefrom and connected to said sealed annular volume.

9. The system of claim 1, further including a plurality of said sections of drilling pipes each having male and female threaded couplings at opposed ends thereof, and each having pressurized fluid coupling means at opposed ends thereof which are joined by engagement of said male and female threaded couplings.

* * * * *